United States Patent [19]

Tamagawa et al.

[11] Patent Number: 4,705,746

[45] Date of Patent: Nov. 10, 1987

[54] PHOTOGRAPHIC POLYOLEFIN COATED PAPER

[75] Inventors: Shigehisa Tamagawa; Tetsuro Fuchizawa, both of Fujinomiya, Japan

[73] Assignee: Fuji Photo Film Co., Ltd., Kanagawa, Japan

[21] Appl. No.: 852,398

[22] Filed: Apr. 15, 1986

Related U.S. Application Data

[63] Continuation of Ser. No. 657,765, Oct. 4, 1984, abandoned.

[30] Foreign Application Priority Data

Oct. 4, 1983 [JP] Japan ..... 58-185303

[51] Int. Cl.[4] ..... G03C 1/76

[52] U.S. Cl. ..... 430/538; 430/536

[58] Field of Search ..... 430/538, 536

[56] References Cited

U.S. PATENT DOCUMENTS

| | | | |
|---|---|---|---|
| 3,525,621 | 8/1970 | Miller | 430/538 |
| 3,607,345 | 9/1971 | Thomas et al. | 430/538 |
| 4,220,471 | 9/1980 | Date et al. | 430/538 |

*Primary Examiner*—Jack P. Brammer

*Attorney, Agent, or Firm*—Jules E. Goldberg

[57] ABSTRACT

A photographic paper comprising a paper sheet coated on each side with a polyolefin resin layer and a photographic emulsion layer provided on the polyolefin resin layer on the front side, which is characterized in that the polyolefin resin layer on the back side is provided with a antistatic coating layer comprising (a) a latex which contains an alkyldiphenylether sulfonate or a formalin condensate of naphthalenesulfonate, (b) colloidal silica, and (c) an alkaline salt aluminate.

7 Claims, No Drawings

PHOTOGRAPHIC POLYOLEFIN COATED PAPER

This is a continuation of application Ser. No. 657,765, filed Oct. 4, 1984, now abandoned.

BACKGROUND OF THE INVENTION

1. Field of the Invention

The present invention relates to a photographic paper, and more particularly to a photographic paper coated with a polyolefin resin.

2. Description of Prior Arts

It is often experienced that a marking due to electrostatic charge (i.e., static mark) appears on a photosensitive surface of a photographic paper coated with a polyolefin resin. The electric charge is generated by friction caused between the surface of the polyolefin resin layer and surfaces of rollers in a process of the preparation of a photographic paper, as well as in a developing process. More specifically, in a process of the preparation of a photographic paper, a polyolefin resin-coated support is coated with a photographic emulsion and then transferred to a dryer part of the emulsion coater, a winder part, and a slitter. In the latter stages, electric charge is generated by friction between the surface of the polyolefin resin layer and the surfaces of the rollers of these parts. In the developing process, a photographic paper is caused to pass through rollers in an automatic printer, an automatic developing machine, etc. In these stages, electric charge is also generated in the same manner. When the charge is discharged, the photographic paper keeps thereron the mark of the discharge as a latent mark. The discharge marks are observed as uneven fogs on the surface of the photographic emulsion layer after the paper is developed.

For the above-described reason, various methods have been utilized in practice to reduce the generation of the electrostatic charge. Examples of the known methods include a method comprising incorporation of an antistatic agent into a polyolefin resin, a method comprising incorporation of an antistatic agent into a paper sheet, and a method of coating a hydrophilic colloid layer having antistatic activity over the back surface of polyolefin resin layer (i.e., a surface opposite to the photographic emulsion-coated surface).

However, these method have following drawbacks, and no satisfactory method has been known for the following reasons.

For the first method, almost no practically suitable antistatic agents are known, because an organic antistatic agent tends to decompose at the high temperature employed for the extrusiton of the polyolefin resin, and an inorganic antistatic agent is not suitable for a photographic paper due to the fact that it causes reduction of strength of the resin layer as well as reduction in whiteness.

Alternatively, there can be employed the third method providing a hydrophilic colloidal layer on the surface of the polyolefin resin on the back side. This method can be performed by coating the polyolefin layer with a hydrophilic polymer material such as gelatin, carboxymethylcellulose, hydroxyethylcellulose, polyvinyl alcohol, or polyacrylamide. However, this method also has various disadvantages, for instance, in the developing stage, the hydrophilic polymer material layer is easily separated or decomposed. Othewise, the hydrophilic polymer material layer tends to adhere to a surface of other photographic paper, or shows sticky property. Accordingly, this method is employed only under restricted conditions.

For the above reasons, the second method comprising addition of an antistatic agent such as an inorganic salt has been utilized more generally. This method is disclosed, for instance, in U.S. Pat. No. 3,253,922, British Pat. No. 1,346,960, and Japanese Patent Publications No. 50(1975)-3114 and No. 56(1981)-53744. However, in the second method, the addition of inorganic salt to a paper sheet causes the following troubles. If an inorganic salt is added in a large amount, pin holes are likely formed in the polyolefin resin layer when the polyolefin layer is subjected to corona discharge treatment. This treatment is usually applied to strengthen bonding between the polyolefin resin layer and the emulsion layer. Further, the photographic characteristics tends to deteriorate during storage after the application of the photographic emulsion. In more detail, fogs likely occur on the photographic emulsion layer.

In addition, the inorganic salt antistatic agent possibly causes rusting in a processing stage such as a surface surface size stage. In view of the possible troubles, the inorganic salt agent should be used in an amount as small as possible. Thus, the inorganic salt antistatic agent is preferably added in an amount of 2% or less based on the weight of paper sheet so that these troubles can be obviated. However, the addition of inorganic salt antistatic agent in the above range exhibits only insufficient antistatic property. Therefore, the processing rate for photographic paper is disadvantageously restricted.

SUMMARY OF THE INVENTION

An object of the present invention is to provide a photographic paper which is improved in the above-mentioned drawbacks, that is, to provide a photographic paper which is reduced in occurrence of the marking arising from electrostatic charge, and which has excellent photograpic characteristics, and gives writing characteristics on the back surface.

The present invention resides in a photographic paper comprising a paper sheet coated on each side with a polyolefin resin layer and a photographic emulsion layer provided on the polyolefin resin layer on the front side, which is characterized in that the polyolefin resin layer on the back side is provided with a coating layer comprising (a) a latex which contains an alkyldiphenylether sulfonate or a formalin condensate of naphthalenesulfonate, (b) colloidal silica, and (c) an alkaline salt aluminate.

In the photographic paper of the invention, said colloidal silica (b) and alkaline salt aluminate (c) are preferably contained in the coating layer in amounts of 10–100 (more preferably, 20–60) parts by weight and 1–10 parts (more preferably, 2–6) by weight, respectively, based on 100 parts by weight of the latex (a) containing an alkyldiphenylether sulfonate or a formalin condensate of naphthalenesulfonate.

In the invention, said alkyldiphenylether sulfonate or a formalin condensate of naphthalenesulfonate is preferably contained in the latex containing the same in an amount of 0.5–5.0% (preferably 0.8–2.0%) by weight.

DETAILED DESCRIPTION OF THE INVENTION

The photographic paper according to the invention comprises a paper sheet (base paper), polyolefin resin-coating layers provided on both sides of the paper, an antistatic back-coating layer provided on the polyolefin resin layer on the back side (i.e., a side not receiving a photographic emulsion layer), and a photographic emulsion layer provided on another polyolefin resin layer on the front side.

A paper sheet used for the preparation of the photographic paper according to the invention can be selected from materials generally used for the preparation of photographic papers. Natural pulps originating from coniferous trees or broadleaf trees and synthetic pulps originating from fibrous polypropylene or polyethylene can be used as matrix constituting materials. Further, various sizing agents, paper strength-increasing agents, fillers, fixing agent, etc., can be employed in conjunction with the pulps if desired. The paper sheet generally has a thickness in the range of 50 to 300 μm.

A homopolymer of α-olefin such as polyethylene or polypropylene, or a copolymer of these μ-olefins can be used as the polyolefin resin for forming the polyolefin resin coating layer of the photographic paper according to the invention. A high density polyethylene, a low density polyethylene, or a mixture of these polyethylenes are preferably used. The thickness of the polyolefin resin layer generally ranges 15 to 50 μm. To the polyolefin resin, pigments, optical brighteners, and antioxidizing agents can be added, if desired.

As preferable latexs employed for the preparation of the latex containing alkyldiphenylether sulfonate or formalin condensate of naphthalenesulfonate, there can be mentioned MBR (methyl methacrylate-butadiene rubber) latex, carboxylated MBR latex, SBR (styrene-butadiene rubber) latex, carboxylated SBR latex, SMBR (styrene-methyl methacrylate-butadiene rubber) latex, and carboxylated SMBR latex, from the viewpoints of satisfactory adhesion to a polyolefin resin such as polyethylene as well as appropriate behaviour in the developing stage.

The alkyldiphenylether sulfonate and formalin condensate of naphthalenesulfonate can be employed independently or in combination.

Preferable examples of colloidal silica used in the invention include a colloidal solution which is formed by dispersing particulate silicic anhydride with diameter of 5 to 100 mμ, preferably with diameter of 10 to 50 mμ, in a medium of water or methanol. The single use of colloidal silica to form the back coating layer hardly gives enough mat surface to the layer. Therefore, if the mat surface is particularly required, for instance, for receiving writing with a pencil, an inorganic pigment with a particle diameter of 0.1 to 10 μm is preferably used in combination of the colloidal silica. Preferable examples of the inorganic pigment include crystalline silica or amorphous synthetic aluminosilicate.

The alkaline salt of aluminic acid (aluminate) in the invention means a salt which can be formed from aluminum oxide and more basic other metal oxide. Examples of the aluminate include sodium aluminate, sodium metaaluminate, sodium metaaluminate anhydride, potassium aluminate, and calcium aluminate. Among these salts, sodium aluminate and potassium aluminate are especially preferred, because these salts are easy to handle and exhibit satisfactory characteristics.

A curing agent of an active halogen-containing compound, for instance, 2,4-dichloro-6-hydroxy-s-triazine sodium salt, 2,4-dichloro-6-methoxy-s-triazine, 2,4-dichloro-6-(2-sulfoethylamino)-s-triazine, or N,N'-bis(2-chloroethylcarbamyl)piperadine are preferably used to increase the film strength of the above-mentioned back coating layer. The coating solution, which is used for the formation of the above-mentioned coating layer on the polyolefin resin layer, generally is an aqueous solution, but an organic solvent such as methanol, ethanol, etc. can be employed in combination with water, if desired.

As the coating method, a generally known coating method, for instance, dip-coating method, air-knife coating method, curtain coating method, roller coating method, doctor coating method, wire-bar coating method, slide coating method, or gravure coating method can be used.

Prior to the coating of the back coating layer, the surface of the polyolefin resin layer is preferably subjected to a conventional activation treatment. An acid-etching treatment, gas burner flame treatment, corona discharge treatment, or glow discharge treatment can be applied as the activation treatment.

There is no specific limitation on the thickness of the back coating layer (i.e., antistatic coating layer), but the antistatic effect which is the main object of the invention is sufficiently given if the coating layer has a thickness of 0.1 to 3 μm.

On the front surface, a photographic emulsion was coated to form a photographic emulsion layer. There was no specific limitation on the photographic emulsion. If desired, a subbing layer or other functional layers can be provided between the resin layer and the photographic emulsion layer in a conventional manner.

The present invention will be described in more detail by the following examples, however the invention will not be restricted to the example.

EXAMPLE 1

Sodium stearate was added to wood pulp (LBKP) beaten to Canadian Freeness Level of 300 cc, in an amount of 1.0 wt.% based on the weight of absolute dry pulp. Subsequently, 1.5 wt.% of aluminum sulfate, 0.5 wt.% of polyamidopolyamine-epichlorohydrin (Kymene 557, tradename of Dic-Hercules Co., Ltd., Japan), and 0.3 wt.% of alkylketenedimer (Acuapel, Dic-Hercules Co., Ltd.) based on the weight of absolute dry pulp were added. Using the resulting slurry, a paper sheet with a weight of 150 g/m$^2$ was prepared by a conventional paper making method. Calcium chloride was then applied onto the paper sheet by the surface sizing in an amount of 1% per the weight of the paper sheet, and the paper sheet was dried. Subsequently, the paper sheet was calendered to have a thickness of 160 μm.

On the back surface of the paper sheet a polyethylene resin having a density of approx. 0.930 g/cm$^3$ was coated to form a resin layer with a thickness of approx. 0.33 mm. On the front surface a polyehtylene resin having a density of approx. 0.960 g/cm$^3$ containing 10% of titanium dioxide was coated to form a resin layer with a thickness of approx. 0.30 mm. Thus, there was prepared a support of a photographic paper.

On the back surface of the support, a coating solution containing a composition indicated in the Table 1 was coated in an amount of 20 cc/m$^2$ by the wire-bar coating method. Subsequently the surface on the side opposite to the above-mentioned coating layer was subjected to the corona discharge treatment. Then, a black and white photographic emulsion was coated to give a photographic papers. Thus, photographic papers according to the present invention (Samples 1, 2 and 3) and photographic papers for reference (Samples 4, 5 and 6) were prepared.

TABLE 1

| Sample Composition of Coating Solution | |
|---|---|
| Sample 1 according to the invention | |
| MBR latex containing 1 wt. % formalin condensate of naphthalenesulfonate as emulsifier | 4.0 parts |
| Colloidal silica (mean particle diameter: 10–20 mμ) | 2.0 parts |
| Sodium aluminate | 0.2 part |
| 2,4-Dichloro-6-hydroxy-s-triazisodium | 0.1 part |
| Water | 93.8 parts |
| Sample 2 according to the invention | |
| Carboxylated SBR latex containing 1.5 wt. % alkyl-diphenyl-ether sulfonate as emulsifier | 4.0 parts |
| Colloidal silica (mean particle diameter: 10–20 mμ) | 2.5 parts |
| Potassium aluminate | 0.2 part |
| 2,4-Dichloro-6-hydroxy-s-triazisodium | 0.1 part |
| Water | 93.2 parts |
| Sample 3 according to the invention | |
| SMBR latex containing 1 wt. % formalin condensate of naphthalenesulfonate as emulsifier | 5.0 parts |
| Colloidal silica (mean particle diameter: 40–50 mμ) | 2.5 parts |
| Sodium aluminate | 0.2 part |
| 2,4-Dichloro-6-hydroxy-s-triazi sodium salt | 0.2 part |
| Water | 92.1 parts |
| Sample 4 for reference | |
| Alkyd emulsion | 4.0 parts |
| Colloidal silica (mean particle diameter: 40–50 mμ) | 2.0 parts |
| Water | 94.0 parts |
| Sample 5 for reference | |
| Gelatin | 4.0 parts |
| Colloidal silica (mean particle diameter: 10–20 mμ) | 2.0 parts |
| 2,4-Dichloro-6-hydroxy-s-triazisodium | 0.2 part |
| Water | 93.8 parts |
| Sample 6 for reference | |
| Polyvinyl alcohol | 5.0 parts |
| Colloidal silica (mean particle diameter: 40–50 mμ) | 2.0 parts |
| Sodium aluminate | 0.2 part |
| Water | 92.8 parts |

The surface electric resistance (SR value) was measured on the photographic paper. Further, certain characters were written on the back surface of the photographic paper using a ball-pointed pen, and the paper was subjected to the conventional photographic treatment. The density of written characters (which indicates fading tendency) and marking arising from electrostatic charge were examined. The results are set forth in Table 2.

TABLE 2

| | Samples according to the invention | | |
|---|---|---|---|
| | Sample 1 | Sample 2 | Sample 3 |
| Surface Resistance | $8.8 \times 10^9$ | $9.2 \times 10^9$ | $5.8 \times 10^9$ |
| Static Mark | Not Observed | Not Observed | Not Observed |
| Character Fading | Not Faded | Not Faded | Not Faded |
| | Samples for reference | | |
| | Sample 4 | Sample 5 | Sample 6 |
| Surface Resistance | $3.0 \times 10^{15}$ | $2.8 \times 10^{14}$ | $8.4 \times 10^{13}$ |
| Static Mark | Observed | Observed | Observed |
| Character Fading | Partly Faded | Mostly Faded | Mostly Faded |

From the results of Table 2, it is obvious that the photographic paper of the invention is substantially free from occurrence of marking due to electrostatic charge (e.g., static mark) and has excellent writing characteristics.

Sample 2

On the back surface of the polyethylene resin-coated paper sheet prepared in the same manner as in Example 1, a coating solution having the composition indicated in Table 3 was coated in an amount of 25 cc/m$^2$ by the roller coating method. Subsequently, the opposite surface (front surface) of the resin-coated paper sheet was subjected to the corona discharge treatment, and a conventional black and white photographic emulsion was coated thereon to give a photographic paper.

Thus, photographic papers according to the present invention (Samples 7 and 8) and photographic papers for reference (Samples 9 and 10) were prepared.

TABLE 3

| Sample Composition of Coating Solution | |
|---|---|
| Sample 7 according to the invention | |
| MBR latex containing 1 wt. % formalin condensate of naphthalenesulfonate as emulsifier | 5.0 parts |
| Colloidal silica (mean particle diameter: 40–50 mμ) | 1.0 parts |
| Crystalline silica (mean particle diameter: 0.5 μm) | 4.0 parts |
| Sodium aluminate | 0.1 part |
| 2,4-Dichloro-6-hydroxy-s-triazisodium | 0.1 part |
| Water | 89.8 parts |
| Sample 8 according to the invention | |
| Carboxylated SBR latex containing 1.5 wt. % alkyl-diphenyl-ether sulfonate as emulsifier | 5.0 parts |
| Colloidal silica (mean particle diameter: 10–20 mμ) | 1.0 parts |
| Synthetic amorphous alumina-silica (mean particle diameter: 1.0 μm) | 3.0 parts |
| Potassium aluminate | 0.1 part |
| 2,4-Dichloro-6-hydroxy-s-triazisodium | 0.1 part |
| Water | 90.8 parts |
| Sample 9 for reference | |
| Polyacrylamide | 5.0 parts |
| Colloidal silica (mean particle diameter: 10–20 mμ) | 1.0 parts |
| Crystalline silica (mean particle diameter: 0.5 μm) | 4.0 parts |
| Water | 90.0 parts |
| Sample 10 for reference | |
| Polyvinyl alcohol | 5.0 parts |
| Colloidal silica (mean particle diameter: 40–50 mμ) | 1.0 parts |
| Synthetic amorphous alumina-silica (mean particle diameter: 1.0 μm) | 4.0 parts |
| Water | 90.0 parts |

The surface electric resistance (SR value) was measured on the photographic paper. Further, certain characters were written on the back surface of the photographic paper using a ball-pointed pen or a pencil, and the paper was subjected to the conventional photographic treatment. The density of written characters (which indicates fading tendency) and marking arising from electrostatic charge were examined. The results are set forth in Table 4.

TABLE 4

| | Samples according to the invention | |
|---|---|---|
| | Sample 7 | Sample 8 |
| Surface Resistance | $4.2 \times 10^9$ | $7.2 \times 10^9$ |
| Static Mark | Not Observed | Not Observed |
| Character Fading (ball-pointed pen) | Little Faded | Little Faded |
| Character Fading | Little Faded | Little Faded |

TABLE 4-continued

| (pencil) | Samples for reference | |
|---|---|---|
| | Sample 9 | Sample 10 |
| Surface Resistance | $6.9 \times 10^{13}$ | $4.1 \times 10^{13}$ |
| Static Mark | Observed | Observed |
| Character Fading (ball-pointed pen) | Mostly Faded | Mostly Faded |
| Character Fading (pencil) | Partly Faded | Partly Faded |

From the results of Table 4, it is obvious that the photographic paper of the invention is substantially free from occurrence of marking due to electrostatic charge (e.g., static mark) and has excellent writing characteristics.

We claim:

1. A photographic paper comprising a paper sheet coated on each side with a polyolefin resin layer and a photographic emulsion layer provided on the polyolefin resin layer on the front side, which is characterized in that the polyolefin resin layer on the back side is provided with a coating layer consisting essentially of:

a latex selected from the group consisting of MBR latex, carboxylated MBR latex, SBR latex, carobxylated SBR latex, SMBR latex and carboxylated SMBR Latex;

an alkyldiphenylether sulfonate or a formalin condensate of naphthalenesulfonate;

a colloidal silica;

an alkaline salt aluminate; and an active halogen-containing curing agent.

2. The photographic paper as claimed in claim 1, in which the active halogen-containing curing agent is selected from the group consisting of 2,4-dichloro-6-hydroxy-s-triazine sodium salt, 2,4-dichloro-6-methoxy-s-triazine, 2,4-dichloro-6-(2-sulfoethylamino)-s-triazine, and N, N'-bis(2-chloroethylcarbamyl)piperadine.

3. The photographic paper as claimed in claim 1, in which the alkaline salt aluminate is selected from the group consisting of sodium aluminate, sodium metaaluminate, sodium metaaluminate anhydride, potassium aluminate and calcium aluminate.

4. The photographic paper as claimed in claim 1, in which said colloidal silica and alkaline salt aluminate are contained in the coating layer in amounts of 10–100 parts by weight and 1–10 parts by weight, respectively, based on 100 parts by weight of the latex containing an alkyldiphenylether sulfonate or a formalin condensate of naphthalenesulfonate.

5. The photographic paper as claimed in claim 4, in which said colloidal silica and alkaline salt aluminate are contained in the coating layer in amounts of 20–60 parts by weight and 2–6 parts by weight, respectively, based on 100 parts by weight of the latex containing an alkyldiphenylether sulfonate or a formalin condensate of naphthalenesulfonate.

6. The photographic paper as claimed in claim 1, in which said alkyldiphenylether sulfonate or a formalin condensate of naphthalenesulfonate is contained in the latex containing the same in an amount of 0.5–5.0% by weight.

7. The photographic paper as claimed in claim 1, in which the latex is MBR latex or SBR latex.

* * * * *